US009734697B1

(12) United States Patent
Modi et al.

(10) Patent No.: US 9,734,697 B1
(45) Date of Patent: Aug. 15, 2017

(54) AUTOMATIC NOTIFY MODE FOR SECURITY SYSTEM

(71) Applicant: Google Inc., Mountain View, CA (US)

(72) Inventors: Yash Modi, San Mateo, CA (US); Greg Fulco, San Francisco, CA (US); Kenneth Louis Herman, San Jose, CA (US)

(73) Assignee: GOOGLE INC. CA (US)

( * ) Notice: Subject to any disclaimer, the term of this patent is extended or adjusted under 35 U.S.C. 154(b) by 0 days.

(21) Appl. No.: 15/088,744

(22) Filed: Apr. 1, 2016

(51) Int. Cl.
*G08B 23/00* (2006.01)
*G08B 25/00* (2006.01)

(52) U.S. Cl.
CPC ..... *G08B 25/008* (2013.01)

(58) Field of Classification Search
CPC ..... G08B 25/008
See application file for complete search history.

(56) References Cited

U.S. PATENT DOCUMENTS 3,829,829 A 8/1974 Teich
4,633,235 A 12/1986 DeGennaro
4,794,368 A 12/1988 Grossheim et al.
5,079,538 A 1/1992 DeFino et al.
6,781,509 B1 * 8/2004 Oppedahl ..... G08B 25/008 340/286.01
7,190,264 B2 3/2007 Brown et al.
7,741,969 B2 6/2010 Linford
8,368,532 B2 * 2/2013 Foisy ..... G08B 25/001 340/506
8,635,499 B2 1/2014 Cohn et al.
9,214,082 B2 * 12/2015 Koenig ..... G08B 25/008
2010/0277315 A1 * 11/2010 Cohn ..... G08B 29/02 340/540
2011/0037593 A1 * 2/2011 Foisy ..... G08B 25/001 340/540
2011/0102588 A1 * 5/2011 Trundle ..... G08B 13/196 348/143
2011/0309929 A1 * 12/2011 Myers ..... G08B 6/00 340/539.11
2012/0286951 A1 * 11/2012 Hess ..... G08B 25/008 340/539.1
2013/0154660 A1 * 6/2013 Bucsa ..... H02H 3/087 324/509
2013/0229277 A1 * 9/2013 Liao ..... G08B 23/00 340/501
2014/0313032 A1 * 10/2014 Sager ..... H04Q 9/00 340/539.17
2015/0188725 A1 * 7/2015 Coles ..... G08B 19/005 700/90

* cited by examiner

*Primary Examiner* — Hai Phan
*Assistant Examiner* — Royit Yu
(74) *Attorney, Agent, or Firm* — Morris & Kamlay LLP

(57) ABSTRACT

A security system is configured to be set in a notify mode if it fails to detect a response from the last person to leave the monitored environment or someone else who have left the house to arm the security system within a finite amount of time. When the security system is in the notify mode, the security system does not generate an alarm signal upon detecting a trigger event that would otherwise trigger an alarm if the system were in a fully armed mode, but instead, transmits a notification to legitimate residents or occupants who have left the monitored environment that the trigger event has occurred.

24 Claims, 4 Drawing Sheets

FIG. 3
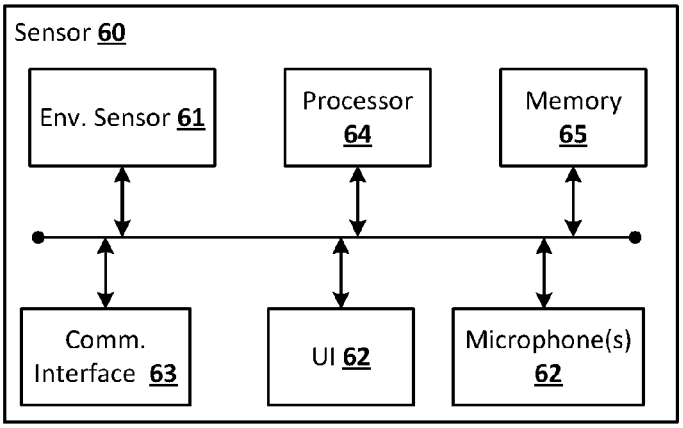
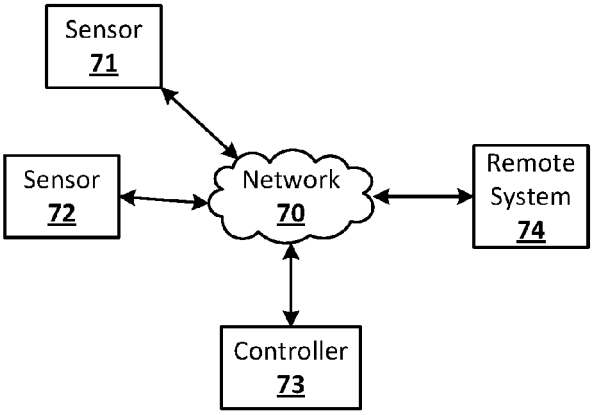
FIG. 4

AUTOMATIC NOTIFY MODE FOR SECURITY SYSTEM

BACKGROUND

Security systems have been implemented to monitor residences, offices, stores, or other types of environments. Such security systems typically have two states, corresponding to armed and unarmed modes of operation. The security system for a house, for example, may be unarmed when one or more legitimate occupants are in the house, and armed when no occupants are in the house. It is usually expected that the last occupant to leave the premises will arm the security system upon leaving the house. Conventional security systems typically are armed by entering an arming code or command via a central device, which causes the other components of the security system to enter the armed state.

BRIEF SUMMARY

According to an embodiment of the disclosed subject matter, a security system includes a sensor configured to detect a presence of one or more persons in an environment, a processor, communicably coupled to the sensor, configured to determine whether a last one of the one or more persons is leaving the environment, an alarm, communicable coupled to the processor, configured to generate an alarm signal upon detecting a trigger event by the sensor when the security system is in an armed mode, and a user device, communicably coupled to the processor, configured to transmit a first notification to at least one of the one or more persons to set the security system in the arm mode in response to a determination that the last one of the one or more persons is leaving the environment, wherein the processor waits for a response from the user device within a finite time duration after notifying the at least one of the one or more persons to set the security system in the armed mode, wherein the security system is set in a notify mode if the response is not received by the processor from the user device within the finite time duration after transmitting the first notification to set the security system in the armed mode, and wherein, in the notify mode, upon detecting the trigger event by the sensor, the alarm does not generate the alarm signal, and the processor transmits a second notification to the one or more persons that the trigger event has occurred.

According to an embodiment of the disclosed subject matter, a method of setting a security system in a notify mode includes determining whether a last one of the one or more persons is leaving an environment, transmitting a first notification to at least one of the one or more persons to arm a security system in response to a determination that the last one of the one or more persons is leaving the environment, waiting for a response from the at least one of the one or more persons within a finite time duration after notifying the at least one of the one or more persons to arm the security system, and setting the security system in a notify mode if the response is not received from the user device within the time duration after transmitting the first notification to arm the security system, wherein, in the notify mode, an alarm signal is not generated, and a second notification is transmitted to the one or more persons upon detection of a trigger event for an alarm.

According to an embodiment of the disclosed subject matter, an apparatus for setting a security system in a notify mode includes a memory and a processor in communication with the memory. In an embodiment, the processor is configured to execute instructions to determine whether a last one of the one or more persons is leaving an environment, to transmit a first notification to at least one of the one or more persons to arm a security system in response to a determination that the last one of the one or more persons is leaving the environment, wait for a response from the at least one of the one or more persons within a finite time duration after notifying the at least one of the one or more persons to arm the security system, and set the security system in a notify mode if the response is not received from the user device within the time duration after transmitting the first notification to arm the security system, wherein, in the notify mode, an alarm signal is not generated, and a second notification is transmitted to the one or more persons upon detection of a trigger event for an alarm.

According to an embodiment of the disclosed subject matter, means for setting a security system in a notify mode are provided, which include means for determining whether a last one of the one or more persons is leaving an environment, means for transmitting a first notification to at least one of the one or more persons to arm a security system in response to a determination that the last one of the one or more persons is leaving the environment, means for waiting for a response from the at least one of the one or more persons within a finite time duration after notifying the at least one of the one or more persons to arm the security system, and means for setting the security system in a notify mode if the response is not received from the user device within the time duration after transmitting the first notification to arm the security system, wherein, in the notify mode, an alarm signal is not generated, and a second notification is transmitted to the one or more persons upon detection of a trigger event for an alarm.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

FIG. 3 shows an example of a sensor according to embodiments of the disclosed subject matter.

FIG. 4 shows an example of a sensor network according to embodiments of the disclosed subject matter.

DETAILED DESCRIPTION

Humans sometimes forget to arm a security system when they leave a monitored environment, such as a house, an apartment, an office, or a store. In a house with multiple occupants, for example, it is expected that the last occupant to leave the house will arm the security system upon leaving the house. However, the last person to leave the house may forget to arm the security system, and the house may remain unarmed after the last person leaves the house. Thus, in a conventional security system, the system may remain unarmed when no occupants are present, although the occupants would desire or intend the system to be armed.

A security system may include a feature that requests the last person to leave the house to arm the security system. If the last person fails to arm the security system upon leaving the house, the security system may generate a reminder to that person to arm the security system. Such a reminder may be transmitted as a buzzer, a beep, a ringtone, a machine-generated human voice, or a visual signal, for example. In some instances, the last person to leave the house may not be alerted by such a reminder. In some instances, that person may be alerted but may choose to ignore such a reminder and continues to leave the house unarmed.

According to embodiments of the disclosed subject matter, the security system is configured to set itself in a notify mode if it fails to detect a response from the last person to leave the monitored environment or someone else who have left the monitored environment to arm the security system. According to embodiments of the disclosed subject matter, when the security system is in the notify mode, upon detecting a trigger event, for example, the presence of an unauthorized person or object, the security system does not generate an alarm signal, for example, a siren, a buzzer, a strobe or a flashing light, but instead, transmits a notification to legitimate residents or occupants who have left the monitored environment that the trigger event has occurred.

Figure 1:
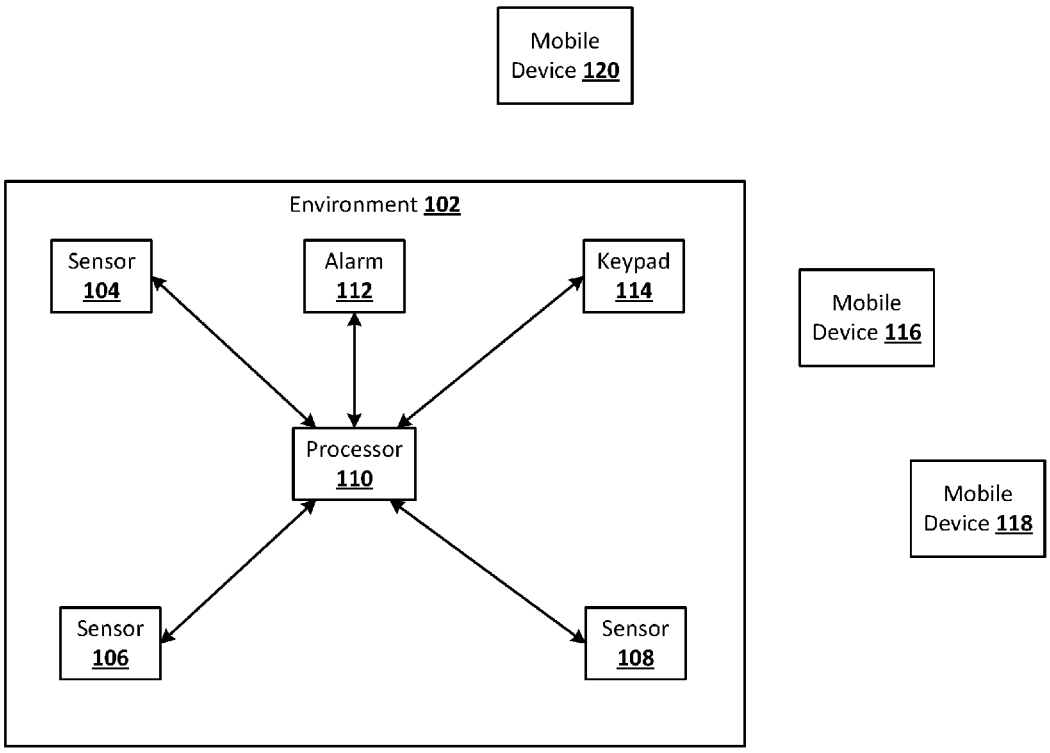
FIG. 1 shows an example of a security system according to embodiments of the disclosed subject matter.

FIG. 1 shows an example of a security system according to embodiments of the disclosed subject matter. The security system may include one or more sensors 104, 106 and 108 for monitoring an environment 102. The environment 102 may be an enclosed environment, such as a residential house or apartment, an office, a store, or a warehouse, for example. In some implementations, the sensors 104, 106 and 108 may be physically located at various locations in the environment 102 such that all areas of the environment are monitored without or with few dead spots. As described in further detail with reference to FIG. 3, various types of sensors may be implemented to monitor the environment 102. The security system may also include a processor 110 coupled to the sensors 104, 106 and 108, and an alarm 112 and a keypad 114 coupled to the processor 110. In some implementations, the sensors 104, 106 and 108, the alarm 112, or the keypad 114 may communicate with the processor 110 through wired or wireless connections, or a combination of both.

In some implementations, the alarm 112 may be an audio or visual alarm for alerting persons within the monitored environment 102 upon detection of a trigger event, such as unauthorized intrusion by a person, an animal, or an object, for example, by one or more of the sensors 104, 106 and 108. For example, the alarm 112 may be an audio alarm capable of generating audio alarm signals such as sirens, beeps, or buzzers, for example, or a visual alarm capable of generating visual alarm signals such as strobes or flashing lights, for example, or a combination of audio and visual alarm signals. In addition or as an alternative to local audio or visual alarm signals, the alarm 112 may be capable of generating silent alarm signals to alert a security monitoring center or a law enforcement agency of a trigger event, such as an unauthorized intrusion. In some implementations, the alarm 112 may generate only a silent alarm signal to notify the security monitoring center or law enforcement agency of an intrusion to avoid alerting the intruder.

Legitimate residents or occupants of the environment 102 may arm or disarm the security system by using one or more user devices, including, for example, a keypad 114 which may be located near a door or exit path, for example. In some implementations, the last person to leave the environment 102 may arm the security system by entering a passcode on the keypad 114, which enables the processor 110 to arm the security system at some time after the last person to exit the environment 102 enters the passcode, for example, 60 seconds after the last person enters the passcode to allow sufficient time for that person to exit. In some implementations, the security system may by armed or disarmed by reading and matching a voice command, a fingerprint, or by using other biometric schemes to verify that the person exiting the environment 102 is legitimately arming or disarming the system.

In some implementations, user devices for arming or disarming the security system may include one or more mobile devices 116, 118 and 120, for example, which allows legitimate residents or occupants of the environment 102 to arm or disarm the security system remotely through wireless connections while they are physically outside the environment 102. Persons with such mobile devices 116, 118 and 120 may arm the security system after they have left the environment 102, or disarm the security system before they enter the environment 102. Attempts to arm or to disarm the security system may be verified by reading and matching a passcode entered on the mobile device, by reading and matching a voice command detected or a fingerprint scanned by the mobile device, or by using other biometric schemes to ensure that such attempts are made by legitimate users.

Figure 2:
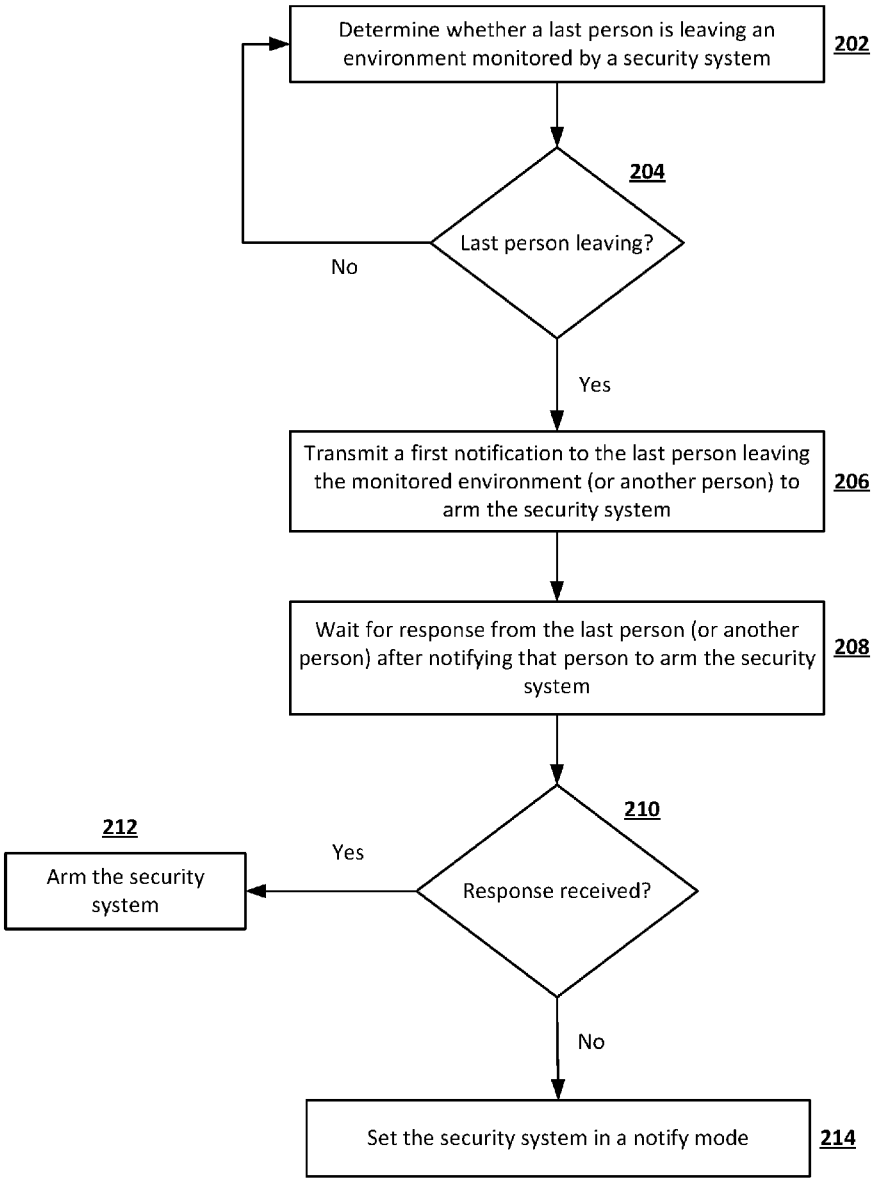
FIG. 2 shows an example of a process of setting a security system in a notify mode according to embodiments of the disclosed subject matter.

FIG. 2 shows an example of a process of setting a security system in a notify mode based upon certain conditions according to embodiments of the disclosed subject matter. The environment 102 in FIG. 1 may be legitimately occupied by one or more persons. One or more sensors 104, 106 and 108 may detect the presence each person and the processor 110 may determine how many persons are initially within the environment 102, for example. The persons may be identified as legitimate occupants based on, for example, a previous entry of an authentication code in the security system, the presence of personal mobile devices such as smart phones that are associated with the legitimate occupants, or the like. Alternatively or in addition, when the security system is in an unarmed state it may be presumed that persons in the environment are legitimate occupants.

Detection of human presence may be achieved by various types of sensors, for example, infrared sensors, radio frequency (RF) sensors, motion sensors, or the like. Thus, the processor may determine whether a last person is leaving the environment being monitored by the security system, as shown in block 202 in FIG. 2. For example, one or more of the infrared sensors may detect heat signatures of one or more persons within the premises. Human bodies may generate heat signatures that can be differentiated from heat signatures generated by pets or objects such as computers or appliances, for example. If the total number of human bodies detected by the infrared sensors is reduced from one to zero, for example, then the processor may determine that the last person is leaving the premises. Visible light cameras may also be used to detect the presence or absence of human beings. Alternatively or in addition, if each legitimate occupant carries a mobile device or smartwatch that is capable of wireless communications, by using Wi-Fi, Bluetooth, or another protocol, RF sensors may detect the presence or absence of such devices. If it is determined that no person is leaving the environment, or that a person leaving the environment is not the last person in block 204, then the security system continues to monitor the environment, and the processor continues to determine whether the last person is leaving the environment in block 202.

On the other hand, if it is determined that the last person is leaving the environment in block 204, then a first notification may be transmitted to the last person leaving the environment to arm the security system, as shown in block 206. In some situations, the last person leaving the environment may be expected to be the person responsible for arming the security system, because no one else would remain in the environment to trigger a false alarm if the system is set in an armed mode. In some implementations, the first notification may be transmitted from the processor 110 to the keypad 114 in FIG. 1, for example, to prompt the last person leaving the environment to set the security system in an armed mode, such as by entering a passcode on the keypad 114. In some implementations, the last person may have a mobile device which may communicate wirelessly with the security system, in which case the first notification to arm the security system may be transmitted to the mobile device. In some implementations, each legitimate resident or occupant of the environment may have a mobile device, and multiple mobile devices, such as mobile devices 116, 118 and 120 as shown in FIG. 1, may be considered part of the security system, even if they are physically located outside the monitored environment 102. In some implementations, the first notification to arm the security system may be transmitted to one or more mobile devices in addition to or other than the mobile device carried by the last person to leave the environment. For example, the last person in a family exiting the monitored environment may be a child or a guest, and the first notification may be transmitted to the mobile device carried by the head of the household instead of the last person exiting the environment. In general, occupants of a smart home or other location may be registered with the security system, and/or may be associated with mobile devices registered with the security system, as described in further detail herein. Thus a smart home system may already have records of the appropriate devices to which such notifications are to be sent.

After the first notification is transmitted to the last person leaving the monitored environment or to another person responsible for the security of the environment, for example, the head of the household whose mobile device has been registered with the security system, the processor may wait for a response from that person, as shown in block 208 of FIG. 2. The last person exiting the environment or the person responsible for arming the security system may be given a finite amount of time to set the security system in an armed mode, by entering a passcode on the keypad 114 or one of the mobile devices 116, 118 and 120, for example, or by making a voice command, scanning a fingerprint, or by using another biometric scheme, for example. The amount of time allowed for the person to arm the security system after receiving the first notification may depend on the amount of reaction time expected of a typical user to set the alarm in an armed mode in response to the first notification, such as 30 seconds or one minute, for example. The specific time period may be determined or set using any of a variety of techniques. For example, the finite amount of time may be determined based on historical data gathered by a smart home system, such as the average time between when a security system is armed and the last user leaves the environment, the travel time between an egress of the environment and a central keypad or other device, or the like. The time also may be determined based on a user-specified setting, a default setting, or the like. As another example, aggregate historical data from multiple smart home systems or similar environments may be used to determine the finite time period. For example, if it is determined that most users of smart home systems do not want the system to remain unarmed for more than two minutes after the last occupant leaves the environment, a time period of two minutes may be used.

If a response to the first notification is received within a finite period of time allowed by the security system in block 210, then the security system may be fully armed in block 212. If any of the sensors detects a trigger event, for example, an intrusion or movement into the monitored environment, an alarm is generated. The alarm may be an audio alarm that generates sirens or beeps, for example, or a visual alarm that generates strobes or flashing lights, or a silent alarm that alerts the security monitoring center or law enforcement agency without alarming the intruder. On the other hand, if a response to the first notification to arm the security system is not received within the finite period of time in block 210, then the security system is set in a notify mode in block 214. When the security system is in the notify mode, if one or more of the sensors in the system detect a trigger event, an alarm signal may not be generated, and a second notification may be transmitted to one or more mobile devices carried by legitimate residents or occupants who are outside the environment when the trigger event is detected. In some implementations, the mobile devices may generate alerts in the form of a buzzer, ringtone or beeping sound, or a machine-generated human voice, for example, or in the form of a text or multimedia message, or in the form of a vibratory signal. In some implementations, a normal alarm signal may be generated in addition to the notification that is sent to one or more occupants or other users.

In some implementations, an occupant or other user that receives a notification as disclosed herein may be able to take additional action with respect to the notification. For example, the notification may indicate an event that was detected after the user left the premises, which normally would trigger an alarm condition in the security system. The user may be presented with an interface that allows the user to cause the usual alarm to sound at the residence, or to suppress the usual alarm, as well as to set the armed condition of the system as previously described. For example, the notification may indicate that the alarm was not armed and that movement was detected in an interior hallway. The occupant receiving the notification may be aware of conditions that would cause such a detection, such as a house pet or other condition, and thus may instruct the system not to activate the usual alarm condition. The user also may instruct the system to arm the system or to leave the system unarmed, separately from instructions related to whether to sound an alarm. As another example, the notification may indicate that the sound of glass breaking was detected near an outside wall shortly after the user left the premises. If the user is not aware of any legitimate condition that would cause such an event, he may instruct the system to sound the usual alarm, notify other occupants or users, or to notify appropriate emergency services such as law enforcement, fire suppression, alarm monitoring services, or the like. The user also may be able to instruct the system to take other actions within a smart home, such as turning various appliances on or off, sounding various alerts or alarms, activating other components of the smart home system such as cameras or other sensors, or the like. In some implementations, when the security system is in the notify mode, various features to deter potential intruders may be provided, for example, by turning lights on and off or turning irrigation sprinklers on and off to fake occupancy. In some implementations, when the security system is in the notify mode, a camera feed may be turned on and video streaming may be provided to the mobile device, automatically or in response to a manual command, to allow the user to monitor the unoccupied house, for example.

In some implementations, when the last person leaves the premises, a first notification is transmitted only to the last person leaving the premises to request that person to arm the security system. In some implementations, if the last person leaving the premises fails to respond to the first notification by arming the security system within a given amount of time, for example, one minute or a few minutes, then notifications requesting arming of the security system may be transmitted to the mobile devices of all family members or occupants of the premises on the security account. If the security system receives a command to arm the system from any one of the family members or occupants, then the system is set in the armed mode. If no response is received from any of the family members or occupants within a given amount of time, for example, one minute or a few minutes, then notifications requesting arming of the security system may be transmitted to mobile devices of emergency contacts that are not family members or occupants. These notifications may be transmitted in the form of short messaging service (SMS) or multimedia messaging service (MMS) messages, audio alerts, or visual alerts, for example. If no response is received from anyone, then the security system may set itself in the silent mode.

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, entry, presence, pressure, light, sound, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is in an "armed" mode or state, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

A sensor may include hardware in addition to the specific physical sensor that obtains information about the environment. FIG. 3 shows an example of a sensor as disclosed herein. The sensor 60 may include an environmental sensor 61, such as a temperature sensor, smoke sensor, carbon monoxide sensor, motion sensor, accelerometer, proximity sensor, infrared sensor, magnetic field sensor, radio frequency (RF) sensor, light sensor, humidity sensor, pressure sensor, microphone, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61 data. A communication interface 63, such as a Wi-Fi or other wireless interface, Ethernet or other local network interface, or the like, may allow for communication by the sensor 60 with other devices. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

In some configurations, two or more sensors may generate data that can be used by a processor of a system to generate a response and/or infer a state of the environment. For example, an ambient light sensor may determine that it is dark (e.g., less than 60 lux) in the room of a home in which it is located. A microphone may detect a sound above a set threshold, such as 60 dB, in the home. The processor may determine, based on the data generated by both sensors that it should activate all of the lights in the room. In the event the processor only received data from the ambient light sensor, it may not have any basis to alter the state of the lighting in the room. Similarly, if the processor only received data from the microphone, it may not make sense to activate the lights in the room because it is daytime or bright in the room (e.g., the lights are already on). As another example, two or more sensors may communicate with one another. Thus, data generated by multiple sensors simultaneously or nearly simultaneously may be used to determine a state of an environment and, based on the determined state, generate a response.

Data generated by one or more sensors may indicate patterns in the behavior of one or more users and/or an environment state over time, and thus may be used to "learn" such characteristics. For example, data generated by an ambient light sensor in a room of a house and the time of day may be stored in a local or remote storage medium with the permission of an end user. A processor in communication with the storage medium may compute a behavior based on the data generated by the light sensor. The light sensor data may indicate that the amount of light detected increases until an approximate time or time period, such as 3:30 PM, and then declines until another approximate time or time period, such as 5:30 PM, at which point there is an abrupt increase in the amount of light detected. In many cases, the amount of light detected after the second time period may be either below a dark level of light (e.g., under or equal to 60 lux) or bright (e.g., equal to or above 400 lux). In this example, the data may indicate that after 5:30 PM, an occupant is turning on/off a light as the occupant of the room in which the sensor is located enters/leaves the room. At other times, the light sensor data may indicate that no lights are turned on/off in the room. The system, therefore, may learn that occupants patterns of turning on and off lights, and may generate a response to the learned behavior. For example, at 5:30 PM, a smart home environment or other sensor network may automatically activate the lights in the room if it detects an occupant in proximity to the home. In some embodiments, such behavior patterns may be verified using other sensors. Continuing the example, user behavior regarding specific lights may be verified and/or further refined based upon states of, or data gathered by, smart switches, outlets, lamps, and the like.

Sensors as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

FIG. 4 shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The controller may be a general- or special-purpose computer. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

The sensor network shown in FIG. 4 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space. One or more of the sensors 71, 72 may be located inside the structure to detect the presence of one or more occupants.

In some implementations, the smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include multiple rooms separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 4 may include multiple devices, including intelligent, multi-sensing, network-connected devices that may integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entry-way interface devices (e.g., "smart doorbells"). The smart hazard detectors, smart thermostats, and smart doorbells may be the sensors 71, 72 shown in FIG. 4.

For example, a smart thermostat may detect ambient climate characteristics (e.g., temperature and/or humidity)

and may control an HVAC (heating, ventilating, and air conditioning) system accordingly of the structure. For example, the ambient client characteristics may be detected by sensors 71, 72 shown in FIG. 4, and the controller 73 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 4, and the controller 73 may control an alarm system to provide a visual and/or audible alarm to the user of the smart-home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 4 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIG. 4. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 72, 72 may detect the power and/or speed of a fan, and the controller 73 may adjusting the power and/or speed of the fan, accordingly. Smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, a smart-home environment may include one or more intelligent, multi-sensing, network-connected entry detectors (e.g., "smart entry detectors"). Such detectors may be or include one or more of the sensors 71, 72 shown in FIG. 4. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIG. 4 can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIG. 4 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment may "learn" who is a user (e.g., an authorized user) and permit the electronic devices associated with those individuals to control the network-connected smart devices of the smart-home environment (e.g., devices communicatively coupled to the network 70), in some embodiments including sensors used by or within the smart-home environment. Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. Thus, the user may have control over how information is collected about the user and used by a system as disclosed herein.

Figure 5:
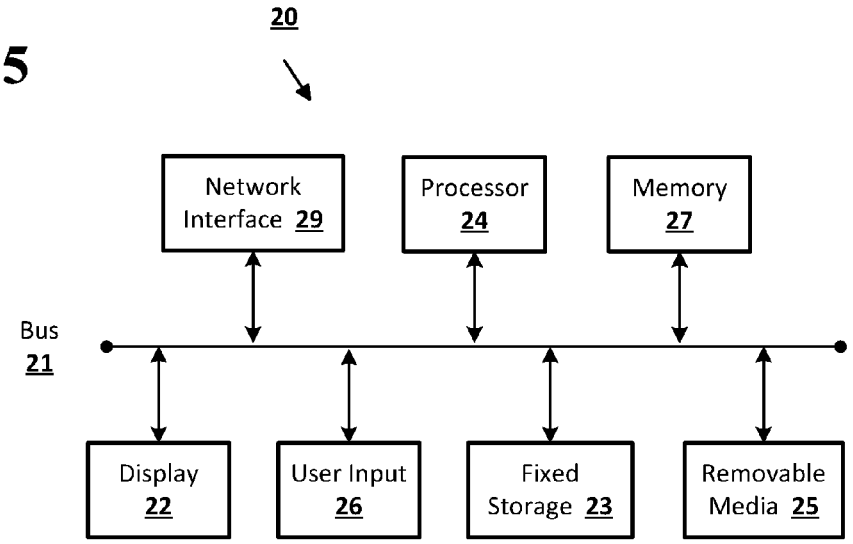
FIG. 5 shows an example of a computing device according to embodiments of the disclosed subject matter.

Embodiments of the presently disclosed subject matter may be implemented in and used with a variety of computing devices. FIG. 5 shows an example of a computing device 20 suitable for implementing embodiments of the presently disclosed subject matter. For example, the device 20 may be used to implement a controller, a device including sensors as disclosed herein, or the like. Alternatively or in addition, the device 20 may be, for example, a desktop or laptop computer, or a mobile computing device such as a smart phone, tablet, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen, a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide such connection using any suitable technique and protocol as will be readily understood by one of skill in the art, including digital cellular telephone, Wi-Fi, Bluetooth®, near-field, and the like. For example, the network interface 29 may allow the device to communicate with other computers via one or more local, wide-area, or other communication networks, as described in further detail herein.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A security system comprising:

a sensor configured to detect a presence of one or more persons in an environment;

an alarm configured to generate an alarm signal upon detecting a trigger event by the sensor when the security system is in an armed mode;

a user device configured to transmit a first notification to at least one of the one or more persons to set the security system in the arm mode in response to a determination that the last one of the one or more persons is leaving the environment; and a processor, communicably coupled to the sensor, the alarm and the user device, the processor configured to:

determine whether a last one of the one or more persons is leaving the environment, wait for a response from the user device within a finite time duration after notifying the at least one of the one or more persons to set the security system in the armed mode, and set the security system in a notify mode if the response is not received by the processor from the user device within the finite time duration after transmitting the first notification to set the security system in the armed mode, wherein in the notify mode, upon detecting the trigger event by the sensor, the alarm does not generate the alarm signal, and the processor transmits a second notification to the one or more persons that the trigger event has occurred.

2. The system of claim 1, wherein the one or more persons are authorized occupants of the environment.

3. The system of claim 1, wherein the alarm signal comprises a signal selected from the group consisting of an audio signal, a visual signal, and a silent alarm signal.

4. The system of claim 1, wherein the user device comprises an alarm keypad.

5. The system of claim 1, wherein the user device comprises a mobile device wirelessly coupled to the processor.

6. The system of claim 5, further comprising one or more additional mobile devices, wherein, in the notify mode, upon detecting the trigger event by the sensor, the processor transmits the second notification to the mobile device and the one or more additional mobile devices.

7. The system of claim 6, wherein the first notification is transmitted to the one or more additional mobile devices.

8. The system of claim 5, wherein the mobile device generates an alert signal selected from the group consisting of an audio signal, a vibratory signal, a text message, and a multimedia message in response to the second notification.

9. A method comprising:

determining whether a last one of one or more persons is leaving an environment;

transmitting a first notification to at least one of the one or more persons to arm a security system in response to a determination that the last one of the one or more persons is leaving the environment;

waiting for a response from the at least one of the one or more persons for a finite time duration after notifying the at least one of the one or more persons to arm the security system; and setting the security system in a notify mode if the response is not received from the user device within the time duration after transmitting the first notification to arm the security system, wherein, in the notify mode, an alarm signal is not generated, and a second notification is transmitted to the one or more persons upon detection of a trigger event for an alarm.

10. The method of claim 9, wherein the one or more persons are authorized occupants of the environment.

11. The method of claim 9, wherein the alarm signal comprises a signal selected from the group consisting of an audio signal, a visual signal, and a silent alarm signal.

12. The method of claim 9, wherein the first notification is transmitted to a user device accessible by the last one of the one or more persons.

13. The method of claim 12, wherein the user device comprises an alarm keypad.

14. The method of claim 12, wherein the user device comprises a mobile device.

15. The method of claim 9, wherein the second notification is transmitted to one or more mobile devices.

16. The method of claim 15, wherein the one or more mobile devices generate one or more alert signals selected from the group consisting of an audio signal, a vibratory signal, a text message, and a multimedia message in response to the second notification.

17. The apparatus of claim 15, wherein the one or more mobile devices generate one or more alert signals selected from the group consisting of an audio signal, a vibratory signal, a text message, and a multimedia message in response to the second notification.

18. An apparatus comprising:

a memory; and a processor in communication with the memory, the processor configured to execute instructions to:

determine whether a last one of the one or more persons is leaving an environment;

transmit a first notification to the at least one of the one or more persons to arm a security system in response to a determination that the last one of the one or more persons is leaving the environment;

wait for a response from the at least one of the one or more persons within a finite time duration after notifying the at least one of the one or more persons to arm the security system; and set the security system in a notify mode if the response is not received from the user device within the time duration after transmitting the first notification to arm the security system, wherein, in the notify mode, an alarm signal is not generated, and a second notification is transmitted to the one or more persons upon detection of a trigger event for an alarm.

19. The apparatus of claim 18, wherein the one or more persons are authorized occupants of the environment.

20. The apparatus of claim 18, wherein the alarm signal comprises a signal selected from the group consisting of an audio signal, a visual signal, and a silent alarm signal.

21. The apparatus of claim 18, wherein the first notification is transmitted to a user device accessible by the last one of the one or more persons.

22. The apparatus of claim 21, wherein the user device comprises an alarm keypad.

23. The apparatus of claim 21, wherein the user device comprises a mobile device.

24. The apparatus of claim 18, wherein the second notification is transmitted to one or more mobile devices.

* * * * *